United States Patent [19]

Miller et al.

[11] Patent Number: 4,647,346

[45] Date of Patent: Mar. 3, 1987

[54] ANODIZED ALUMINUM SUPPORT, METHOD FOR THE PREPARATION THEREOF AND LITHOGRAPHIC PRINTING PLATE CONTAINING SAME

[75] Inventors: Gary R. Miller, Fort Collins, Colo.; Richard E. Gilson, Rochester, N.Y.

[73] Assignee: Eastman Kodak Company, Rochester, N.Y.

[21] Appl. No.: 786,012

[22] Filed: Oct. 10, 1985

[51] Int. Cl.[4] ..... C25D 11/12; B41N 1/08

[52] U.S. Cl. ..... 204/29; 204/17; 204/38.3; 204/33; 204/58; 430/270; 430/278; 430/302

[58] Field of Search ..... 204/17, 58, 33, 29, 204/38.3; 430/270, 278, 302

[56] References Cited

U.S. PATENT DOCUMENTS

| | | | |
|---|---|---|---|
| 3,208,849 | 9/1965 | Steinle | 430/278 |
| 3,511,661 | 5/1970 | Rauner et al. | 96/86 |
| 3,594,289 | 7/1971 | Watkinson et al. | 204/38 A |
| 3,808,000 | 4/1974 | Magnotta et al. | 430/278 |
| 3,836,437 | 9/1974 | Osada et al. | 204/17 |
| 3,860,426 | 1/1975 | Cunningham et al. | 430/278 |
| 4,127,451 | 11/1978 | Marceau et al. | 204/58 |
| 4,153,461 | 5/1979 | Berghaüser | 430/278 |
| 4,229,266 | 10/1980 | Usbeck | 204/33 |
| 4,542,089 | 9/1985 | Cadwell et al. | 430/278 |
| 4,581,996 | 4/1986 | Platzer | 430/302 |
| 4,596,189 | 6/1986 | Halpern | 430/302 |
| 4,604,341 | 8/1986 | Mohr | 430/278 |
| 4,608,131 | 8/1986 | Brenk | 430/278 |

FOREIGN PATENT DOCUMENTS

| | | | |
|---|---|---|---|
| 2324506 | 5/1973 | Fed. Rep. of Germany | |
| 60-101539 | 6/1985 | Japan | 430/278 |
| 1051991 | 12/1966 | United Kingdom | 430/278 |

OTHER PUBLICATIONS

"Structural Features of Oxide Coatings on Aluminum," Journal of the Electrochemical Society, vol. 100, No. 9, p. 411, Sep. 1953.

*Primary Examiner*—Arthur P. Demers
*Attorney, Agent, or Firm*—Alfred P. Lorenzo

[57] ABSTRACT

In an anodized aluminum support for use in a lithographic printing plate comprising an anodic surface stratum consisting essentially of oxides and phosphates of aluminum; the improvement wherein said surface stratum has an average thickness greater than 0.50 micrometers, is present in a coverage of greater than 600 milligrams per square meter of support, and has a web-like surface structure characterized by the presence of a multiplicity of interlacing filaments having average widths within the range of from about 0.03 to about 0.15 micrometers. The support is prepared by a process of anodically oxidizing at least one surface of an aluminum plate in an aqueous electrolyte, wherein the electrolyte comprises from about 15 to 30% phosphoric acid by weight, and the anodic oxidation is carried out at an anodizing voltage of at least about 50 volts at an electrolyte temperature of from about 25° C. to about 50° C. and at an anodizing condition of at least 2.5 amp-min/dm$^2$. A lithographic printing plate comprising a radiation sensitive layer and the above-described support exhibits improved resistance to abrasion.

15 Claims, 3 Drawing Figures

ANODIZED ALUMINUM SUPPORT, METHOD FOR THE PREPARATION THEREOF AND LITHOGRAPHIC PRINTING PLATE CONTAINING SAME

CROSS REFERENCE TO RELATED APPLICATIONS

Reference is hereby made to commonly-assigned copending U.S. patent applications Ser. No. 786,403 entitled TREATED ANODIZED ALUMINUM SUPPORT, METHOD FOR THE PREPARATION THEREOF AND LITHOGRAPHIC PRINTING PLATE CONTAINING SAME filed in the names of R. E. Gilson and G. R. Miller concurrently herewith, and Ser. No. 786,013 entitled SUBBED LITHOGRAPHIC PRINTING PLATE filed in the names of G. R. Miller and R. E. Gilson concurrently herewith.

BACKGROUND OF THE INVENTION

1. Field of the Invention

This invention relates to a novel phosphoric acid anodized aluminum support for use in a lithographic printing plate and to a method for the preparation of such support and to a lithographic printing plate comprising the support exhibiting improved abrasion resistance.

2. Description of the Prior Art

An important property of any lithographic surface is the resistance which it exhibits to abrasion in the background or non-image areas. Poor abrasion resistance manifests itself during the printing operation as a gradual wearing away of the non-image surface or as tracks around the plate in the direction of rotation caused by particles imbedded in press rollers.

It is known to prepare lithographic printing plates having good abrasion resistance having a sulfuric acid anodized aluminum support. The sulfuric acid anodized support, however, having thick cell walls and fine pore diameters, does not provide a surface sufficiently porous to achieve adequate adhesion.

U.S. Pat. No. 3,511,661 discloses a lithographic printing plate comprising a phosporic acid anodized aluminum surface. The aluminum surface stratum comprises a cellular pattern of aluminum oxide consisting of cells with porous openings about $20\times10^{-9}$ m–$75\times10^{-9}$ m in average diameter, thus providing a surface sufficiently porous to achieve good adhesion. The surface stratum comprises about 10 to 200 mg/m$^2$ aluminum phosphate.

U.S. Pat. No. 4,229,266 relates to the use of a mixture of sulfuric acid and phosphoric acid in forming the anodic layer of a lithographic printing plate. According to this patent, only relatively thin layers are obtained when phosphoric acid alone is used as the electrolyte in the anodizing process, due to the strong redissolving capacity of phosphoric acid towards aluminum oxide, and this is said to result in inferior abrasion resistance for phosphoric acid anodized layers.

Thus, there is a need for lithographic printing plates exhibiting improved abrasion resistance yet having a support surface sufficiently porous to achieve adequate adhesion.

SUMMARY OF THE INVENTION

In accordance with the present invention, there is provided a lithographic printing plate having improved abrasion resistance and a support surface sufficiently porous to achieve adequate adhesion.

The invention provides an anodized aluminum support, for use in a lithographic printing plate, comprising an anodic surface stratum consisting essentially of oxides and phosphates of aluminum having an average thickness greater than 0.50 micrometers. The anodic stratum is present in a coverage of greater than 600 milligrams per square meter of support and has a web-like surface structure characterized by the presence of a multiplicity of interlacing filaments having average widths within the range of from about 0.03 to about 0.15 micrometers.

The invention further provides, in a method of preparing such support by anodically oxidizing at least one surface of an aluminum plate in an aqueous electrolyte comprising phosphoric acid, the improvement wherein the electrolyte comprises from about 15 to 30% phosphoric acid by weight, and the anodic oxidation is carried out at an anodizing voltage of at least about 50 volts at an electrolyte temperature of from about 25° C. to about 50° C. and at an anodizing condition of at least 2.5 amp.min/dm$^2$.

A lithographic printing plate in accordance with the present invention comprises a radiation sensitive layer and the above-described anodized aluminum support. The lithographic printing plate of this invention exhibits improved resistance to abrasion.

DETAILED DESCRIPTION OF THE PREFERRED EMBODIMENTS

The support material comprises an aluminum or aluminum alloy plate. Suitable aluminum alloys include alloys with zinc, silicon, chromium, copper, manganese, magnesium, chromium, zinc, lead, bismuth, nickel, iron or titanium which may contain negligible amounts of impurities.

The surface of the aluminum plate is preferably subjected to chemical cleaning such as degreasing with solvents or alkaline agents for the purpose of exposing a clean surface free of grease, rust or dust which is usually present on the aluminum surface. Preferably, the surface is grained. Suitable graining methods include glass bead graining, ball graining, sand blasting, brush graining and electrolytic graining. Following the graining operation, the support can be treated with an aluminum etching agent and a desmutting acid bath.

An anodized stratum is then formed on at least one surface of the aluminum plate. An electric current is passed through the support immersed as a cathode in an electrolytic solution containing phosphoric acid.

The anodized surface stratum consists essentially of oxides and phosphates of aluminum and is present in a coverage of greater than 600 milligrams per square meter of support. The average thickness of the surface stratum is greater than 0.50 micrometers. In a preferred embodiment of this invention, the surface stratum has an average thickness greater than 0.70 micrometers. The oxides and phosphates of aluminum preferably are present in a coverage of greater than 800 milligrams per square meter of support.

Figure 1:
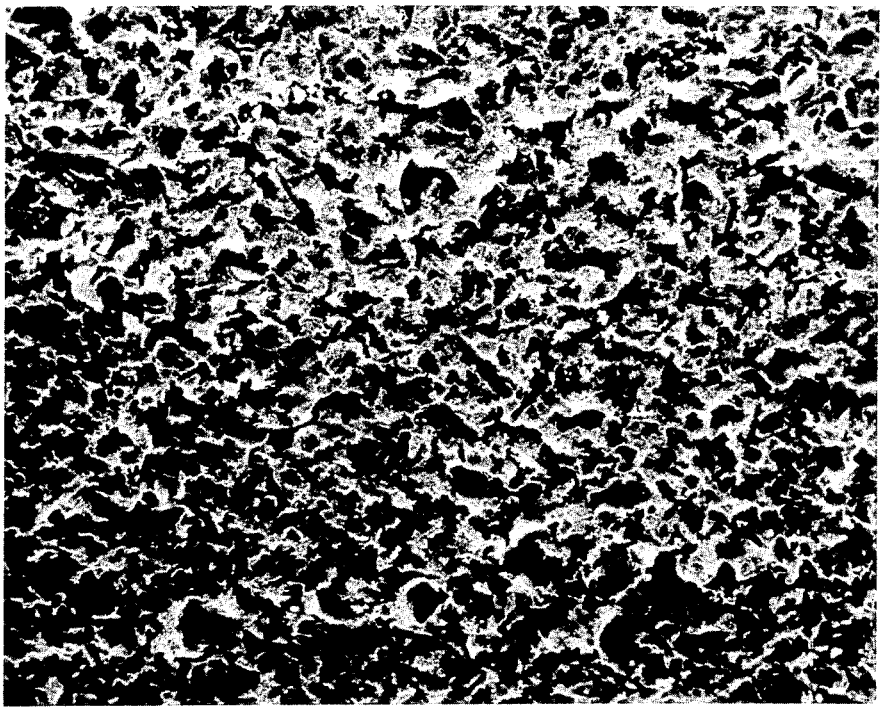
FIG. 1 is a photomicrograph showing the web-like surface structure of the anodic surface stratum of the aluminum support of this invention as viewed through a scanning electron microscope at 750× magnification.
Figure 2:
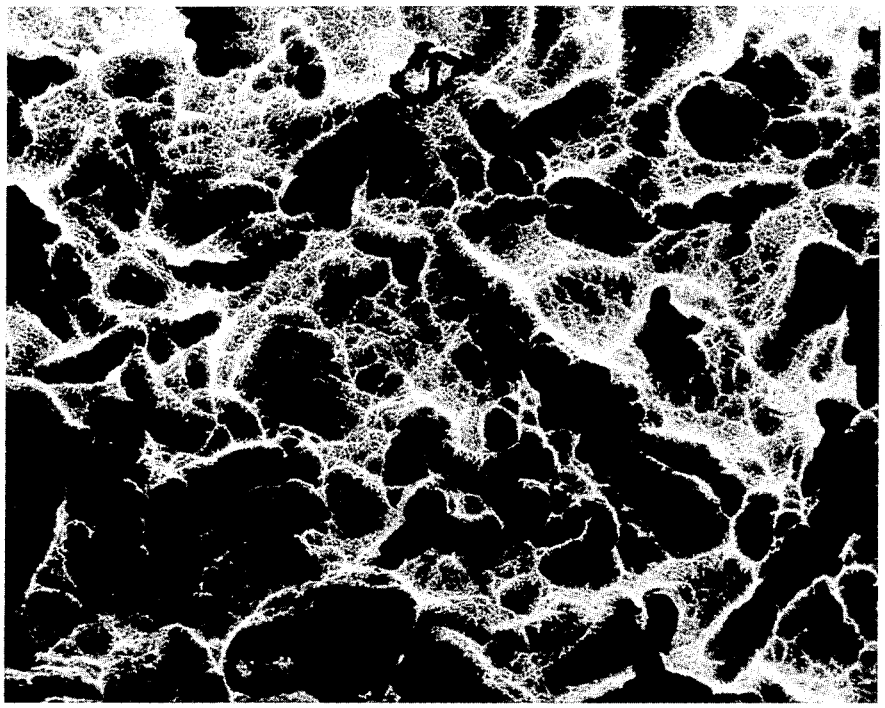
FIG. 2 is a photomicrograph as in FIG. 1 at 3750× magnification.
Figure 3:
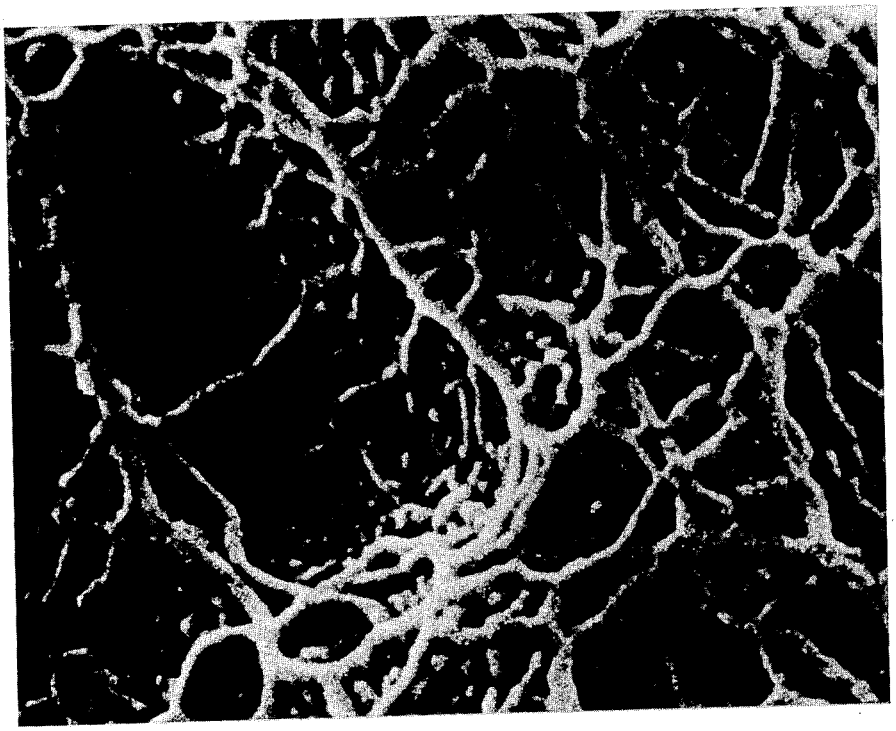
FIG. 3 is a photomicrograph as in FIG. 1 at 40,000× magnification. The multiplicity of interlacing filaments which characterize the web-like surface structure of the support of this invention are evident at this magnification.

The support of this invention has a web-like surface structure characterized by the presence of a multiplicity of interlacing filaments as depicted in FIG. 3. The interlacing filaments have average widths within the range of from about 0.03 to about 0.15 micrometers, more preferably within the range of from about 0.05 to about 0.12 micrometers. If the average widths of the interlacing filaments exceed about 0.15 micrometers, poor adhesion results between the surface of the support and the radiation sensitive layer. Lithographic printing plates prepared from supports containing interlacing filaments having average widths less than 0.3 micrometers exhibit good adhesion but poor sensitivity performance.

The above-described support of this invention is prepared in a process of anodically oxidizing at least one surface of an alumimum plate in an aqueous electrolyte comprising phosphoric acid. The aqueous electrolyte comprises from about 15 to 30%, preferably 17–22% phosphoric acid by weight. The anodic oxidation is carried out at an anodizing voltage of at least 50 volts, and preferably at an anodizing voltage of at least 70 volts. An anodizing condition of at least 2.5 amp-.min/dm$^2$ is required to provide the above described anodized stratum. The anodization preferably takes place at an anodizing condition greater than 3.0 amp-.min/dm$^2$. A range of typical anodizing times is from about 15 seconds to 3 minutes. The electrolyte temperature during anodization can range from about 25° C. to about 50° C., however, the preferred electrolyte temperature range is from about 30° C. to 40° C. Below 25° C., an extremely high voltage is required, and hot spots result. Above 50° C., the rate of dissolution of the anodized stratum is too great.

In a preferred embodiment of this invention, the anodized surface is treated in accordance with the teaching of our copending U.S. application Ser. No. 786,403, entitled TREATED ANODIZED ALUMINUM SUPPORT, METHOD FOR THE PREPARATION THEREOF AND LITHOGRAPHIC PRINTING PLATE CONTAINING SAME, hereby incorporated by reference in its entirety. Thus, the anodized support surface can be silicated and subsequently contacted with a metal salt having the formula MX wherein M is a metal selected from the group consisting of Zn, Mg, Ni and Cr and X is an anion selected from the group consisting of acetate, borate, and chloride. The resulting lithographic printing plate support material comprises an anodized aluminum plate having an anodic layer, a silicate layer in contact with the anodic stratum, and a metal salt layer, in contact with the silicate layer which comprises a metal salt having the formula MX wherein M is a metal selected from the group consisting of zinc, magnesium, nickel and chromium and X is an anion selected from the group consisting of acetate, chloride and borate.

The treated or untreated support can be coated, if desired, with a thin coating of a hydrophilic material. The hydrophilic coating contributes to improving the water receptivity of the non-printing areas of the processed plate. Preferably, the hydrophilic coating is coated over a support treated as described above. The hydrophilic coating is coated by known techniques in a subbing amount. It is particularly advantageous to use a water-soluble permanently hydrophilic material which can be coated from an aqueous dispersion. A solution containing polyacrylamide is especially advantageous for this purpose, as are solutions containing carboxymethyl cellulose, polyvinylphosphonic acid, sodium silicate and combinations of these. Other polymers useful in forming hydrophilic interlayers include polyvinylalcohol, copolymers of maleic anhydride with ethylene, vinyl acetate, styrene or vinyl methyl ether, polyacrylic acid, hydroxymethyl cellulose and polyvinyl pyrrolidone. A particularly useful hydrophilic subbing composition is described in U.S. Pat. No. 3,860,426. In a preferred embodiment of this invention, the treated or untreated support is coated with a hydrophilic subbing composition in accordance with the teaching of our copending U.S. patent application Ser. No. 786,013, entitled SUBBED LITHOGRAPHIC PRINTING PLATE, hereby incorporated by reference in its entirety. Thus, the hydrophilic subbing layer can comprise carboxymethylcellulose, benzoic acid and optionally sodium molybdate and/or a surfactant.

The lithographic printing plate of this invention comprises a radiation sensitive layer and the above-described support. A radiation sensitive coating is placed directly on the treated or untreated support or preferably, over one or more subbing layers. Supports prepared in accordance with the teaching of this invention are sufficiently porous to achieve good adhesion.

Various radiation sensitive materials suitable for forming images for use in the lithographic printing process can be used. Almost any radiation sensitive layer is suitable which after exposure, if necessary followed by developing and/or fixing, provides an area in imagewise distribution which may be used for printing.

Radiation sensitive materials useful in this invention are well known in the art, and include silver halide emulsions, as described in Research Disclosure, publication 17643, paragraph XXV, Dec., 1978 and references noted therein; quinone diazides (polymeric and non-polymeric), as described in U.S. Pat. No. 4,141,733 (issued Feb. 27, 1979 to Guild) and references noted therein; light sensitive polycarbonates, as described in U.S. Pat. No. 3,511,611 (issued May 12, 1970 to Rauner et al) and references noted therein; diazonium salts, diazo resins, cinnamal-malonic acids and functional equivalents thereof and others described in U.S. Pat. No. 3,342,601 (issued Sept. 19, 1967 to Houle et al) and references noted therein; and light sensitive polyesters, polycarbonates and polysulfonates, as described in U.S. Pat. No. 4,139,390 (issued Feb. 13, 1979 to Rauner et al) and references noted therein.

Particularly useful radiation sensitive materials are photocrosslinkable polymers, such as polyesters, containing the photosensitive group $$-CH{=}CH-\overset{\overset{\displaystyle O}{\|}}{C}-$$

as an integral part of the polymer backbone. For example, preferred photocrosslinkable polymers are polyesters prepared from one or more compounds represented by the following formulae:

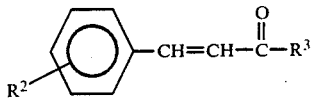

(A)

wherein $R^2$ is one or more alkyl of 1 to 6 carbon atoms, aryl of 6 to 12 carbon atoms, aralkyl of 7 to 20 carbon atoms, alkoxy of 1 to 6 carbon atoms, nitro, amino, acrylic, carboxyl, hydrogen or halo and is chosen to provide at least one condensation site; and $R^3$ is hydroxy, alkoxy of 1 to 6 carbon atoms, halo or oxy if the compound is an acid anhydride. A preferred compound is p-phenylene diacrylic acid or a functional equivalent thereof. These and other useful compounds are described in U.S. Pat. No. 3,030,208 (issued Apr. 17, 1962 to Schellenberg et al); U.S. Pat. No. 3,702,765 (issued Nov. 14, 1972 to Laakso); and U.S. Pat. No. 3,622,320 (issued Nov. 23, 1971 to Allen), the disclosures of which are incorporated herein by reference.

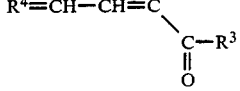

$R^3$ is as defined above, and $R^4$ is alkylidene of 1 to 4 carbon atoms, aralkylidene of 7 to 16 carbon atoms, or a 5- to 6-membered heterocyclic ring. Particularly useful compounds of formula (B) are cinnamylidenemalonic acid, 2-butenylidenemalonic acid, 3-pentenylidenemalonic acid, o-nitrocinnamylidenemalonic acid, naphthylallylidenemalonic acid, 2-furfurylideneethylidenemalonic acid and functional equivalents thereof. These and other useful compounds are described in U.S. Pat. No. 3,674,745 (issued July 4, 1972 to Philipot et al), the disclosure of which is incorporated herein by reference.

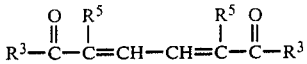

$R^3$ is as defined above; and $R^5$ is hydrogen or methyl. Particularly useful compounds of formula (C) are trans, trans-muconic acid, cis, transmuconic acid, cis, cis-muconic acid, $\alpha,\alpha'$-cis, trans-dimethylmuconic acid, $\alpha,\alpha'$-cis, cis-dimethylmuconic acid and functional equivalents thereof. These and other useful compounds are described in U.S. Pat. No. 3,615,434 (issued Oct. 26, 1971 to McConkey), the disclosure of which is incorporated herein by reference.

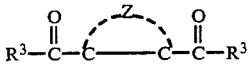

(D)

$R^3$ is as defined above; and Z represents the atoms necessary to form an unsaturated, bridged or unbridged carbocyclic nucleus of 6 or 7 carbon atoms. Such nucleus can be substituted or unsubstituted. Particularly useful compounds of formula (D) are 4-cyclohexene-1,2-dicarboxylic acid, 5-norbornene-2,3-dicarboxylic acid, hexachloro-5[2:2:1]-bicycloheptene-2,3-dicarboxylic acid and functional equivalents thereof. These and other useful compounds are described in Canadian Pat. No. 824,096 (issued Sept. 30, 1969 to Mench et al), the disclosure of which is incorporated herein by reference.

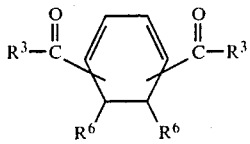

(E)

$R^3$ is as defined above; and $R^6$ is hydrogen, alkyl of 1 to 12 carbon atoms, cycloalkyl of 5 to 12 carbon atoms or aryl of 6 to 12 carbon atoms. $R^6$ can be substituted, where possible, with such substituents as do not interfere with the condensation reaction, such as halo, nitro, aryl, alkoxy, aryloxy, etc. The carbonyl groups are attached to the cyclohexadiene nucleus meta or para to each other, and preferably para. Particularly useful compounds of formula (E) are 1,3-cyclohexadiene-1,4-dicarboxylic acid, 1,3-cyclohexadiene-1,3-dicarboxylic acid. 1,5-cyclohexadiene-1,4-dicarboxylic acid and functional equivalents thereof. These and other useful compounds are described in Belgian Pat. No. 754,892 (issued Oct. 15, 1970), the disclosure of which is incorporated herein by reference.

The radiation-sensitive coating can be prepared by dispersing the radiation sensitive composition or polymer in any suitable solvent or combination of solvents used in the art.

Radiation-sensitivity can be stimulated in the coating composition by incorporating a sensitizer. Suitable sensitizers include anthrones, such as 1-carbethoxy-2-keto-3-methyl-2-azabenzanthrone, benzanthrone; nitro sensitizers; triphenylmethanes; quinones; cyanine dye sensitizers; naphthone sensitizers such as 6-methoxybeta-2-furyl-2-acrylonaphthone; pyrylium or thiapyrylium salts, such as 2,6-bis(p-ethoxyphenyl)-4-(p-n-amyloxyphenyl)-thiapyrylium perchlorate and 1,3,5-triphenylpyrylium fluoroborate; furanone; 4-picoline-N-oxide; anthraquinones such as 2-chloroanthraquinone; thiazoles such as 2-benzoylcarbethoxymethylene-1-methylbetanaphthothiazole and methyl 2-(n-methylbenzothiazolylidene)dithioacetate; methyl 3-methyl-2-benzothiazolidene dithioacetate; thiazolines such as 3-ethyl-2-benzoylmethylenenaphtho[1,2-d]-thiazoline, benzothiazoline, (2-benzoylmethylene)-1-methyl-beta-naphthothiazoline; 1,2-dihydro-1-ethyl-2-phenacylidenenaphtho[1,2-d]-thiazole; and naphthothiazoline; quinolizones, Michler's ketone; and Michler's thioketone.

In addition to the sensitizers, a number of other addenda can be present in the coating composition and ultimately form a part of the lithographic plate. For example, dyes or pigments may be included to obtain colored images to aid in recognition. Other components which can be advantageously included in the coating composition are materials which serve to improve film formation, coating properties, adhesion of the coatings to the support, mechanical strength and stability.

The lithographic printing plate of the present invention can be exposed by conventional methods, for example through a transparency or a stencil, to an imagewise pattern of actinic radiation. Suitable radiation sources include sources rich in visible radiation and sources rich in ultraviolet radiation. Carbon arc lamps, mercury vapor lamps, fluorescent lamps, tungsten filament lamps, photoflood lamps, lasers and the like are useful herein.

The exposed lithographic printing plate can be developed using conventional developer and developing techniques. For example, in developing the lithographic printing plates incorporating radiation-sensitive polyesters noted above, the developer composition is applied to the surface of the plate for a period of time sufficient to remove the polymer from non-image areas of the plate. Gentle mechanical action aids in removing the polymer composition from these areas. Thus, swabbing is a useful method of applying the developer composition to the plate. The developer composition is typically used at room temperature but it can be employed at elevated temperatures up to about 32° C. After the initial application of the developer composition, a second application can be applied, followed by either a single or double application of a desensitizing composition. The plate is then dried.

The following examples further illustrate the practice of this invention:

dragged across the plate surface and the weight on the stylus increased until a continuous scratch could be seen across the oxide surface penetrating into the underlying aluminum. The abrasion resistance is thus reported as minimum grams required to produce a continuous scratch. Although in actual practice plate performance varies widely depending on press conditions, we have found a good correlation between the abrasion resistance measured by our above-described test and number of acceptable impressions to failure.

The anodic layers of examples 1–15 and comparative examples A–D all exhibited a web-like surface structure characterized by the presence of a multiplicity of interlacing filaments having average widths within the range of from about 0.03 to about 0.15 micrometers. However, comparative examples A–D exhibited inferior abrasion resistance in comparison with examples 1–15, as a result of the fact that they were prepared under conditions outside the scope of the process of this invention and, in consequence thereof, did not exhibit the thickness and coverage of the novel anodized aluminum support materials of this invention.

| Example | Phosphoric Acid Concentration % | Phosphoric Acid Temperature °C. | Anodizing Voltage | Anodizing Amp-min./dm$^2$ | Face Side Oxide Mass g/m$^2$ | Thickness of Anodized Stratum micrometers | Abrasion Resistance grams |
|---|---|---|---|---|---|---|---|
| A | 19.2 | 27 | 72.9 | 1.83 | 0.51 | 0.37 | 7 |
| B | 19.3 | 29 | 72.8 | 1.26 | 0.60 | 0.41 | 9 |
| C | 19.3 | 29 | 73 | 2.26 | 0.60 | 0.41 | 9 |
| D | 32.5 | 39 | 62 | 2.37 | 0.54 | 0.50 | 4 |
| 1 | 19.3 | 32 | 72.9 | 2.79 | 0.73 | 0.58 | 12 |
| 2 | 19.3 | 35 | 72.8 | 3.51 | 0.88 | 0.73 | 15 |
| 3 | 19.1 | 38 | 72.1 | 4.22 | 0.93 | 0.87 | 14 |
| 4 | 22.4 | 29 | 73 | 2.58 | 0.66 | 0.53 | 12 |
| 5 | 25.6 | 29 | 73 | 2.99 | 0.76 | 0.67 | 12 |
| 6 | 27.8 | 29 | 73 | 3.78 | 0.82 | 0.73 | 12 |
| 7 | 19.3 | 32 | 73 | 2.80 | 0.73 | 0.58 | 12 |
| 8 | 22.3 | 32 | 73 | 3.30 | 0.85 | 0.67 | 13 |
| 9 | 25.6 | 32 | 73 | 3.82 | 0.92 | 0.79 | 15 |
| 10 | 27.5 | 32 | 73 | 4.44 | 0.95 | 0.82 | 15 |
| 11 | 15.5 | 41 | 73 | 4.14 | 0.94 | 0.88 | 16 |
| 12 | 17.5 | 38 | 73 | 4.00 | 0.94 | 0.87 | 17 |
| 13 | 19.2 | 36 | 73 | 3.71 | 0.90 | 0.73 | 16 |
| 14 | 21.0 | 41 | 80 | 4.30 | 1.05 | 1.00 | 16 |
| 15 | 21.0 | 36 | 80 | 3.23 | 0.91 | 0.93 | 14 |

EXAMPLES 1–15 AND COMPARATIVE EXAMPLES A–D

A 12 mil aluminum plate is immersed in a caustic solution to remove oil and dirt from the surface. The surface is grained with a brush and a slurry of abrasive media. Loose residue is removed by etching in a caustic solution followed by an acid desmutting bath.

The aluminum plate is then anodized in a phosphoric acid electrolyte under the conditions listed below.

The anodized plate was treated in a 3% solution of PQ-D sodium silicate sold by PQ Corporation. The $SiO_2$ to $Na_2O$ ratio was about 2:1. The anodized plate was immersed in a bath having a temperature of 82° C. for about 45 seconds. The silicated anodized plate was rinsed, dried and coated with a polyacrylamide subbing layer as described in U.S. Pat. No. 3,860,426.

The plate was then coated with a radiation sensitive coating as described in U.S. Pat. No. 3,030,208, a condensation product of hydroxyethoxycyclohexane and p-phenylenediethoxy acrylate.

The physical properties of the anodized aluminum support are set forth in the following table. The abrasion resistance of the non-image portion of each plate was measured as follows. A diamond stylus was Although the invention has been described in considerable detail with particular reference to certain preferred embodiments thereof, variations and modifications can be effected within the spirit and scope of the invention.

What is claimed is:

1. In an anodized aluminum support for use in a lithographic printing plate, said support comprising an anodic surface stratum consisting essentially of oxides and phosphates of aluminum; the improvement wherein said surface stratum has an average thickness greater than 0.50 micrometers, is present in a coverage of greater than 600 milligrams per square meter of support, and has a web-like surface structure characterized by the presence of a multiplicity of interlacing filaments having average widths within the range of from about 0.03 to about 0.15 micrometers.

2. The support of claim 1 wherein said surface stratum has an average thickness greater than 0.70 micrometers.

3. The support of claim 1 wherein said oxides and phosphates of aluminum are present in a coverage of greater than 800 milligrams per square meter of support.

4. The support of claim 1 wherein said interlacing filaments have average widths within the range of from about 0.05 to about 0.12 micrometers.

5. In a process of anodically oxidizing at least one surface of an aluminum plate in an aqueous electrolyte comprising phosphoric acid, the improvement wherein the electrolyte comprises from about 15 to 30% phosphoric acid by weight, and the anodic oxidation is carried out at an anodizing voltage of at least about 50 volts at an electrolyte temperature of from about 25° C. to about 50° C. and at an anodizing condition of at least 2.5 amp·min/dm$^2$, whereby said anodic oxidation creates on the surface of said plate an anodic stratum consisting essentially of oxides and phosphates of aluminum, wherein said surface stratum has an average thickness greater than 0.50 micrometers, is present in a coverage of greater than 600 milligrams per square meter of support, and has a web-like surface structure characterized by the presence of a multiplicity of interlacing filaments having average widths within the range of from about 0.03 to about 0.15 micrometers.

6. The process of claim 5 wherein said anodizing voltage is at least 70 volts.

7. The process of claim 5 wherein said electrolyte comprises from about 17 to 22% phosphoric acid by weight.

8. The process of claim 5 wherein said electrolyte temperature is from about 30° C. to about 40° C.

9. The process of claim 5 wherein said anodizing condition is at least 3.0 amp·min/dm$^2$.

10. The product prepared by the process of claim 5.

11. In a lithographic printing plate comprising a radiation sensitive layer and an anodized aluminum support comprising at least one anodic surface stratum consisting essentially of oxides and phosphates of aluminum, the improvement wherein said surface stratum has an average thickness greater than 0.50 micrometers, is present in a coverage of greater than 600 milligrams per square meter of support, and has a web-like surface structure characterized by the presence of a multiplicity of interlacing filaments having average widths within the range of from about 0.03 to about 0.15 micrometers.

12. The plate of claim 11 further comprising a hydrophilic layer.

13. The plate of claim 10 having a silicate layer in contact with the anodic stratum, and a metal salt layer, in contact with the silicate layer, which comprises a metal salt having the formula MX wherein M is a metal selected from the group consisting of zinc, magnesium, nickel and chromium and X is an anion selected from the group consisting of acetate, chloride and borate.

14. The plate of claim 13 further comprising a hydrophilic subbing layer comprising carboxymethylcellulose and benzoic acid.

15. The plate of claim 13 wherein said metal salt is zinc acetate.

* * * * *